United States Patent [19]

Thomsen

[11] Patent Number: 4,893,733

[45] Date of Patent: Jan. 16, 1990

[54] FILLING HEAD WITH QUICK-CHANGE NOZZLE

[76] Inventor: Peter N. Thomsen, 138 Baumont Ave., San Francisco, Calif. 94118

[21] Appl. No.: 274,821

[22] Filed: Nov. 22, 1988

[51] Int. Cl.[4] ..... B65B 55/08

[52] U.S. Cl. ..... 222/153; 222/559; 141/313; 141/367; 53/468

[58] Field of Search ..... 222/92, 105, 153, 189, 222/460, 504, 559; 141/2, 10, 177, 313–314, 317, 367–368, 382, 386; 53/467–469; 383/66

[56] References Cited

U.S. PATENT DOCUMENTS

| | | | |
|---|---|---|---|
| 3,289,712 | 12/1966 | Smith | 141/367 |
| 4,731,978 | 3/1988 | Martensson | 53/468 |
| 4,805,378 | 2/1989 | Anderson | 53/426 |

FOREIGN PATENT DOCUMENTS

| | | | |
|---|---|---|---|
| 56701 | 7/1982 | European Pat. Off. | 141/314 |

*Primary Examiner*—Michael S. Huppert

*Attorney, Agent, or Firm*—Phillips, Moore, Lempio & Finley

[57] ABSTRACT

A bag filling machine, adapted to fill a plastic bag with a liquid product through a gland secured to the bag, comprises a filling head including a fill tube having a piston reciprocally mounted therein for selectively filling the bag with the product. A replaceable nozzle is positioned at an outlet of the fill tube and is releasably attached thereto. An annular seal is secured on a distal end of the nozzle for engaging an annular bearing surface of the gland in sealing contact therewith. Thus, nozzles, having seals and flow passages of varied diameters, may be selectively attached to the fill tube to accommodate glands having varied diameters.

12 Claims, 1 Drawing Sheet

FILLING HEAD WITH QUICK-CHANGE NOZZLE

TECHNICAL FIELD

This invention relates generally to a filling head used for liquid packaging systems and more particularly to a replaceable nozzle adapted to fill a plastic bag with a liquid product through a gland thereof.

BACKGROUND OF THE INVENTION

The advantages of liquid filling and packaging machines for filling plastic bags with a liquid product, such as milk or wine, has given rise to the need for a nozzle that is efficient in operation and that can be replaced for use with glands having varied diameters. Present day machines of this type each includes a nozzle that is structurally integrated with a filling head to solely fill a plastic bag with liquid product through a gland having a set diameter. When the machine is utilized for filling the bag through a gland having a different diameter, the entire filling head assembly must be removed and replaced to accommodate the same.

SUMMARY OF THE INVENTION

An object of this invention is to provide an improved and highly efficient filling head for a liquid packaging machine, adapted to fill a plastic bag through a gland.

The filling head comprises a fill tube having an inlet conduit communicating therewith for supplying a liquid product to the fill tube. A piston is reciprocally mounted in the fill tube for movement between a raised position for permitting the liquid product to flow from the inlet conduit through the fill tube and a lowered position blocking flow of the product from the inlet conduit through the fill tube. A replaceable nozzle is releasably attached to distal end of the fill tube and defines a flow passage therethrough communicating with an outlet of the fill tube. An annular seal is secured on a distal end and bottom side of the nozzle to engage an annular bearing surface defined on an upper end of the gland of the bag, into which the liquid product flows.

The "quick-change" nozzle is thus adapted to be replaced with a nozzle having a seal of different diameter to accommodate glands having varied diameters.

BRIEF DESCRIPTION OF THE DRAWINGS

Other objects and advantages of this invention will become apparent from the following description and accompanying drawings wherein.

DESCRIPTION OF THE PREFERRED EMBODIMENT

Figure 1:
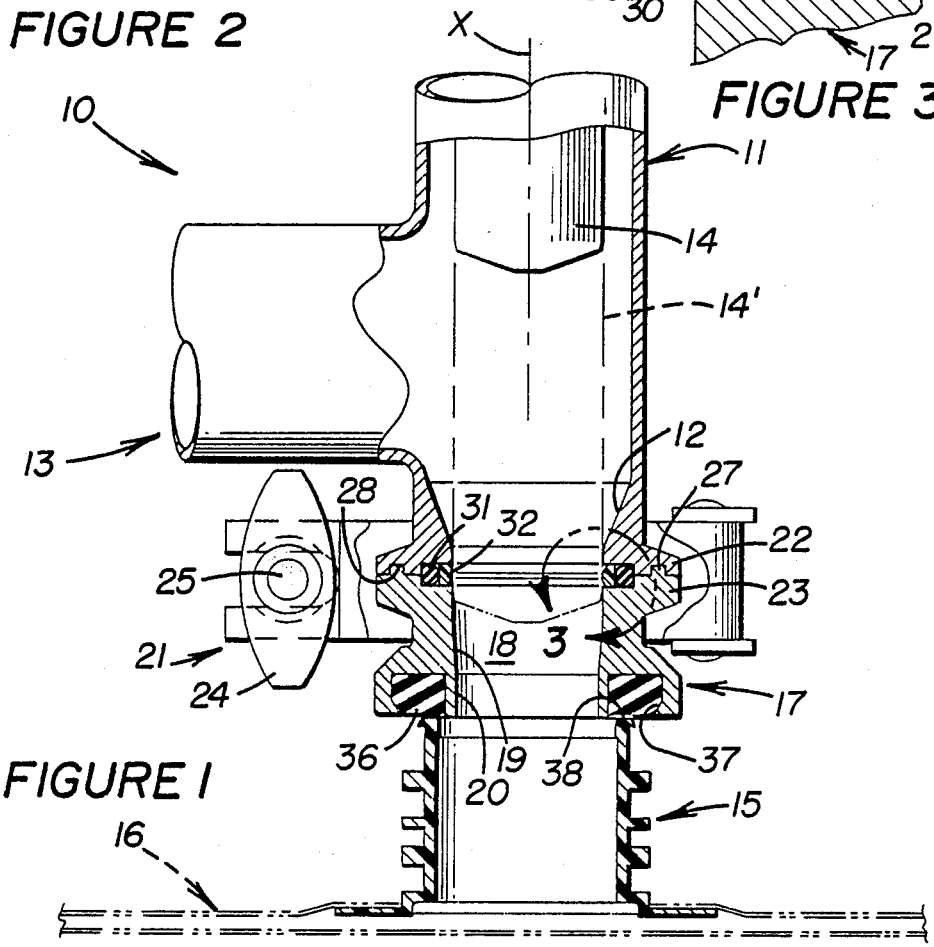
FIG. 1 is a partially sectioned elevational view, partially illustrating a filling head for communicating a liquid product to a gland of a plastic bag.

FIG. 1 partially illustrates a filling head 10 comprising a vertically disposed fill tube 11 terminating at its distal end at a frusto-conically shaped outlet 12. An inlet conduit 13, disposed transversely relative to fill tube 11, is adapted to selectively supply a liquid product to the fill tube in a conventional manner. The liquid product may constitute any common food or other type product adapted to be stored in a liquid packaging system, such as milk, wine and fruit juices.

A piston 14 is reciprocally mounted in fill tube 11 for movement along a longitudinal axis X thereof, in a conventional manner. In particular, the piston is adapted to be moved between its illustrated raised position 14 for permitting the liquid product to flow from inlet conduit 13 and through outlet 12 of the fill tube and a lowered phantom-lined position 14' blocking flow of the product from the inlet conduit through the outlet of the fill tube. When the piston is in its illustrated raised position for filling purposes, the liquid product is adapted to flow through the fill tube, through a generally cylindrical gland 15 and into a plastic bag 16, having the gland suitably secured thereto in a conventional manner.

This invention is drawn to a quick-change annular nozzle 17 having its proximal end positioned at the distal end of fill tube 11 to define a flow passage 18 communicating with the outlet of the fill tube. When viewed in cross-section, an upper section 19 of flow passage 18 is frusto-conically shaped and converges towards a distal end of the nozzle to exhibit a taper that is less than the taper of outlet 12. The stepped-down convergence of outlet 12 and section 19 induces streamlined and non-turbulent flow of the liquid product therethrough. A distal end section 20 of flow passage 18, merging with tapered section 19, is cylindrical to create a venturi-effect, further aiding the filling process, when the liquid product flows through the larger inlet of gland 15.

An attachment means 21 releasably attaches the proximal end of nozzle 17 to the distal end of fill tube 11. The attachment means comprises a conventional, flexible steel band clamp mounted and adapted to uniformly apply a clamping pressure circumferentially about annular radial flanges 22 and 23 formed on the distal end of the fill tube and the proximal end of the nozzle, respectively. Outer surfaces of the flanges are tapered to converge radially outwardly towards each other, in the manner illustrated in FIG. 1, to provide a camming action for tightly clamping the flanges together.

Figure 2:
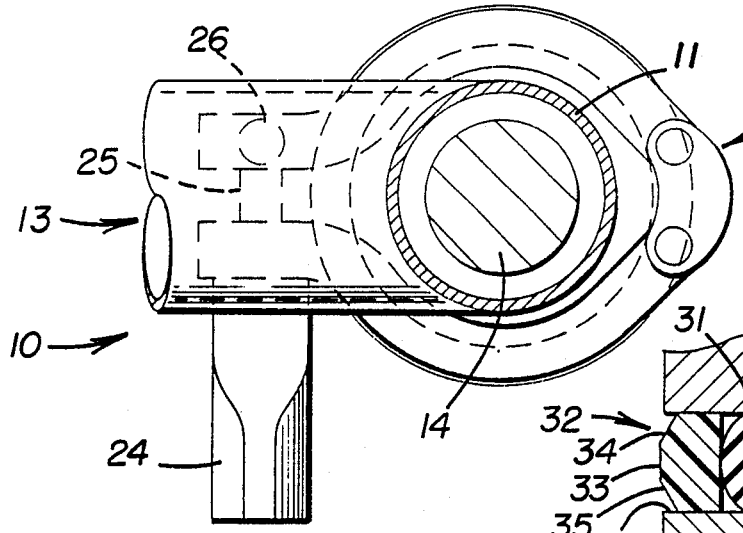
FIG. 2 is a top plan view of the filling head.

The band clamp includes a nut 24, threadably mounted on the end of a shank 25. The shank is pivotally mounted on the clamp by a pin 26 whereby loosening of the nut will permit the shank to be pivoted clockwise in FIG. 2 for purposes of selectively changing nozzle 17 to accommodate glands of varied diameters. An annular centering flange 27 is formed integrally on the upperside of flange 23 and engages within a groove 28, formed on the underside of flange 22, to precisely center the nozzle on the distal end of fill tube 11 and about axis X.

Figure 3:
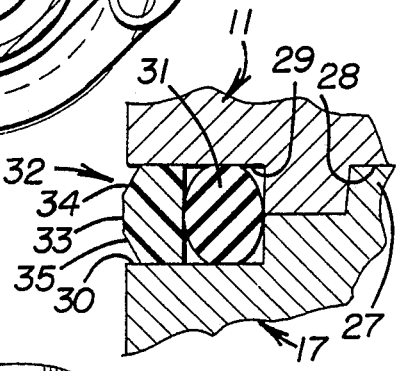
FIG. 3 is enlarged sectional view of a sealing arrangement employed in the filling head, taken within circle III in FIG. 1.

As shown in FIGS. 1 and 3, opposed recesses 29 and 30 are defined within facing surfaces of the tube and nozzle, radially inwardly from flange 22 and 23. The recesses accommodate an annular rubber O-ring or compression seal 31 and an annular face seal 32 composed of polytetrafluroethylene (Teflon). When then clamp is tightened, seal 31, disposed on the outboard side of seal 32, will compress and force the latter seal radially inwardly to position a frontal face 33 thereof slightly within (FIG. 3) the lower end of flow passage 18, i.e., the inside diameter of seal 32 is slightly less than the outside diameter of piston 14. A frusto-conically shaped upper face 34 of the seal is tapered to converge downwardly towards flow passage 18 to facilitate unimpeded passage of piston 14 thereby (closed position 14' in FIG. 1). A lower frusto-conically shaped face 35 of the seal is tapered in an opposite direction.

An annular elastomeric static seal 36, composed of silicone rubber, is suitably secured within an annular recess 37 formed on a distal end and bottom side of nozzle 17. A flat face of seal 36 is adapted to engage an annular bearing surface 38, defined on an upper end of gland 15, to provide a positive sealing contact therebetween when the liquid product is allowed to fill bag 16. It should be noted that the exposed contacting area of seal 36 is substantially larger than the exposed area of bearing surface 38 of the gland (approximately from two to four times) to insure that the seal does not damage edges of the gland and to further provide a side-to-side tolerance for self-alignment purposes. Further, seal 36 is positioned radially outwardly from section 20 of flow passage 18 to aid in providing the venturi-effect described above.

I claim:

1. A filling head for communicating a liquid product through a generally cylindrical gland, defining an annular bearing surface on an upper end thereof, said filling head comprising a fill tube having an outlet at a distal end thereof, an inlet conduit communicating with said fill tube for supplying said liquid product thereto, piston means reciprocally mounted in said fill tube for movement between a raised position for permitting said product to flow from said inlet conduit through the outlet of said fill tube and a lowered position blocking flow of said product from said inlet conduit through the outlet of said fill tube, an annular nozzle having a proximal end positioned at the distal end of said fill tube and defining a flow passage therethrough communicating with the outlet of said fill tube, attachment means for releasably attaching the proximal end of said nozzle to the distal end of said fill tube, and annular sealing means secured on a distal end and bottom side of said nozzle for engaging the annular bearing surface of said gland in sealing contact therewith.

2. The filling head of claim 1 wherein the outlet of said fill tube is frusto-conically shaped, when viewed in cross-section, and converges towards the flow passage of said nozzle.

3. The filling head of claim 2 wherein an upper section of said flow passage, adjacent to said outlet, is frusto-conically shaped, when viewed in cross-section, and converges towards a distal end of said nozzle.

4. The filling head of claim 3 wherein the taper of the upper section of said flow passage is less than the taper of the outlet of said fill tube.

5. The filling head of claim 3 wherein a distal end section of said flow passage is cylindrical and merges with the upper section thereof.

6. The filling head of claim 5 wherein said sealing means is positioned radially outwardly from the distal end section of said flow passage.

7. The filling head of claim 1 wherein said attachment means comprises a flexible band clamp.

8. The filling head of claim 7 further comprising radial flanges formed on the distal end of said fill tube and the proximal end of said nozzle, said flanges having tapered outer surfaces that converge radially outwardly towards each other and wherein said band clamp is circumferentially mounted on said flanges to clamp them together.

9. The filling head of claim 8 further comprising recesses defined within facing surfaces of said fill tube and nozzle, radially inwardly from said nozzle, an annular face seal disposed in said recesses and having a frontal face having an inside diameter slightly less than an outside diameter of said piston means and a compression seal means disposed in said recesses, outboard of said face seal, for compressing said face seal radially inwardly towards said axis.

10. The filling head of claim 9 wherein said face seal further comprises a frusto-conically shaped upper face, merging with said frontal face, converging downwardly towards said flow passage.

11. The filling head of claim 1 wherein said sealing means comprises an annular elastomeric seal having a flat face for engaging the annular bearing surface of said gland.

12. The filling head of claim 11 wherein the area of said flat face is at least twice the area of said bearing surface.

* * * * *